US008365863B2

(12) United States Patent
Astor

(10) Patent No.: US 8,365,863 B2
(45) Date of Patent: Feb. 5, 2013

(54) WORK PLATFORM FOR A LADDER AND METHOD

(75) Inventor: Kyle G. Astor, Meadville, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 11/441,411

(22) Filed: May 24, 2006

(65) Prior Publication Data

US 2007/0181761 A1 Aug. 9, 2007

Related U.S. Application Data

(63) Continuation-in-part of application No. 11/347,613, filed on Feb. 3, 2006.

(51) Int. Cl.
*E06C 5/32* (2006.01)
*A47G 29/02* (2006.01)

(52) U.S. Cl. ..... 182/129; 248/238

(58) Field of Classification Search ..... 182/129; 248/210, 211, 238
See application file for complete search history.

(56) References Cited

U.S. PATENT DOCUMENTS

| | | | | | |
|---|---|---|---|---|---|
| 3,738,601 | A * | 6/1973 | Gehringer | 248/210 |
| 3,768,592 | A * | 10/1973 | Higgins | 182/22 |
| 3,829,051 | A * | 8/1974 | Emmons | 248/238 |
| 4,016,955 | A * | 4/1977 | Gates | 182/122 |
| D248,777 | S * | 8/1978 | Spencer et al. | D25/68 |
| 4,261,435 | A * | 4/1981 | Winter | 182/129 |
| 4,862,994 | A * | 9/1989 | Hughes, Sr. | 182/122 |
| 5,052,581 | A * | 10/1991 | Christ et al. | 220/570 |
| 5,158,023 | A * | 10/1992 | Allen | 108/42 |
| 5,419,409 | A * | 5/1995 | Corulla | 182/129 |
| 5,460,241 | A * | 10/1995 | LaBelle | 182/214 |
| 6,880,794 | B1 * | 4/2005 | Kahn | 248/315 |
| 7,077,238 | B2 * | 7/2006 | Butler et al. | 182/129 |
| 7,159,694 | B2 * | 1/2007 | Gibson | 182/165 |
| D541,433 | S * | 4/2007 | Wise | D25/68 |
| 2002/0017430 | A1 * | 2/2002 | Rosko | 182/129 |
| 2005/0150724 | A1 * | 7/2005 | Snider et al. | 182/129 |

OTHER PUBLICATIONS

Little Giant Ladder Systems, "Little Giant Work Platform," Advertising Brochure, (May 23, 2005).

* cited by examiner

*Primary Examiner* — Alvin Chin Shue
(74) *Attorney, Agent, or Firm* — Ansel M. Schwartz

(57) ABSTRACT

A work platform for a ladder includes a support assembly that removably attaches to the ladder. The platform includes a tray which attaches to the assembly. The tray has a plane having a front and a rear. The plane has at least a first bin for holding small parts, a tool lasso slot, at least one screwdriver hole, and at least one drill holster slot. A method for using a work platform for a ladder includes the steps of obtaining small parts from a first bin in a plane of a tray held to a ladder with a support assembly of the platform. There is the step of placing at least one screwdriver in a screwdriver hole in the plane for holding the screwdriver. There is the step of placing a drill in a drill holster slot in the plane. There is the step of placing a quart can of paint in a quart recess in the plane. There is the step of placing a paint scraper in a paint scraper slot in the plane.

4 Claims, 2 Drawing Sheets

Figure 2
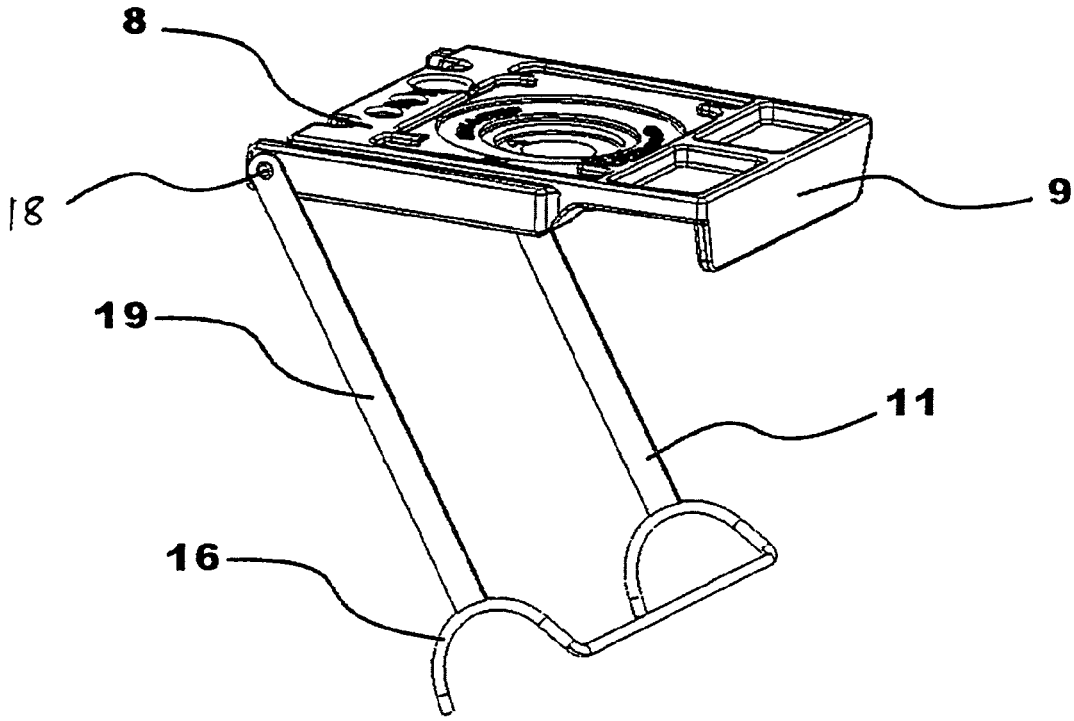
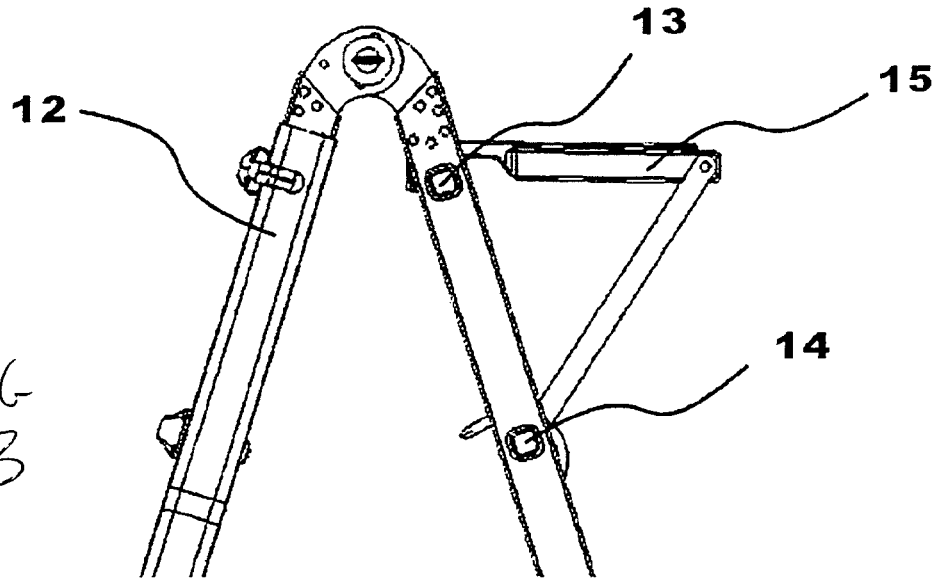
FIG 3

WORK PLATFORM FOR A LADDER AND METHOD

This application is a continuation-in-part of copending application Ser. No. 11/347,613 filed on Feb. 3, 2006.

FIELD OF THE INVENTION

The present invention is related to a work platform for a ladder having a tray with various slots and holes to hold a hammer or a screwdriver or a drill. More specifically, the present invention is related to a work platform for a ladder having a tray with various slots and holes to hold a tool lasso or a screwdriver or a drill and having recesses for different sized containers.

BACKGROUND OF THE INVENTION

A versatile steel work platform is currently offered by a number of companies for use on multiple purpose (MT) ladders. The Little Giant by Wing offers a steel work platform. The plastic tray of the present invention is attached to the ladder the same manner as these earlier versions.

SUMMARY OF THE INVENTION

The present invention pertains to a work platform for a ladder. The platform comprises a support assembly that removably attaches to the ladder. The platform comprises a tray which attaches to the assembly. The tray has a plane having a front and a rear. The plane has at least a first bin for holding small parts, a tool lasso slot, at least one screwdriver hole, and at least one drill holster slot.

The present invention pertains to a method for using a work platform for a ladder. The method comprises the steps of obtaining small parts from a first bin in a plane of a tray held to a ladder with a support assembly of the platform. There is the step of placing at least one screwdriver in a screwdriver hole in the plane for holding the screwdriver. There is the step of placing a tool lasso with a tool in a tool lasso slot in the plane. There is the step of placing a drill in a drill holster slot in the plane. There is the step of placing a quart can of paint in a quart recess in the plane. There is the step of placing a paint scraper in a paint scraper slot in the plane.

BRIEF DESCRIPTION OF THE DRAWINGS

In the accompanying drawings, the preferred embodiment of the invention and preferred methods of practicing the invention are illustrated in which:

FIG. 2 is a perspective view of a work platform of the present invention.

FIG. 3 is a side view of the work platform attached to a ladder.

DETAILED DESCRIPTION

Figure 1:
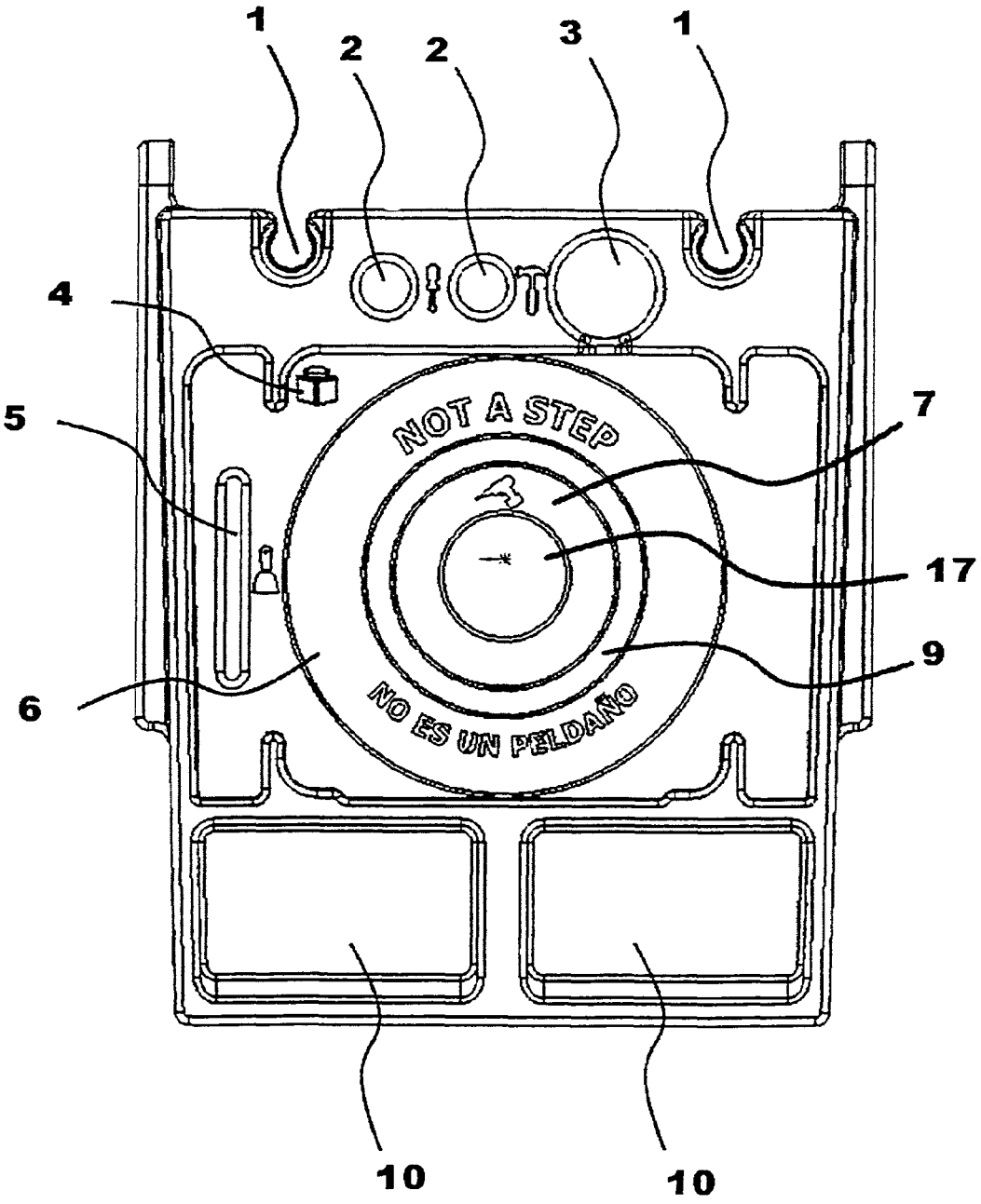
FIG. 1 is an overhead view of a work platform of the present invention.

Referring now to the drawings wherein like reference numerals refer to similar or identical parts throughout the several views, and more specifically to FIGS. 1-3 thereof, there is shown a work platform for a ladder 12. The platform comprises a support assembly that removably attaches to the ladder 12. The platform comprises a tray 8 which attaches to the assembly. The tray 8 has a plane having a front and a rear.

The plane has at least a first bin for holding small parts, a tool lasso slot, at least one screwdriver hole, and at least one drill holster slot 17.

Preferably, the plane has at least one hammer hole 3. The plane preferably has a gallon recess 6, a quart recess 9 and a pint recess 7 to hold a gallon, quart and pint container, respectively. Preferably, the plane has a paint scraper 5 slot to hold a paint scraper 5. The tray 8 is preferably made of plastic. Preferably, the plane has a second bin disposed adjacent the first bin. The pint recess 7 is preferably disposed in the quart recess 9 and the quart recess 9 is disposed in the gallon recess 6. Preferably, the plane has a square gallon holder 4.

The plane preferably has a screwdriver image adjacent the screwdriver hole 2. Preferably, the plane has a hammer image adjacent the hammer hole 3. The plane preferably has a paint scraper 5 image adjacent the paint scraper 5 slot. Preferably, the assembly 19 includes a straight bar 11 attached to the tray 8, and a formed rod 16 attached to the straight bar 11 which engages a first horizontal of the ladder 12. Preferably, the tray 8 has an edge which engages a second horizontal of the ladder 12.

The present invention pertains to a method for using a work platform for a ladder 12. The method comprises the steps of obtaining small parts from a first bin in a plane of a tray 8 held to a ladder 12 with a support assembly of the platform. There is the step of placing a tool lasso with a tool in a tool lasso slot in the plane. There is the step of placing at least one screwdriver in a screwdriver hole 2 in the plane for holding the screwdriver. There is the step of placing a drill in a drill holster slot 17 in the plane. There is the step of placing a quart can of paint in a quart recess 9 in the plane. There is the step of placing a paint scraper 5 in a paint scraper 5 slot in the plane.

Tray

FIG. 1 shows the plastic utility tray 8 and the features it encompasses.

The Tool Lasso slots 1 are used with the Werner Tool Lasso bungee system. These slots 1 are used with the tool lasso system to secure tools to the tray 8 while the user is up on the ladder 12.

The tray 8 features two screwdriver holes 2, which are located next to each other to provide a place for the ends of pliers. Next to the screwdriver holes 2 is the hammer hole 3. The drill holster slot 17 and the accompanying icon are located at the center of the paint can recesses 6, 7, and 9. The tray 8 has two small parts trays 10. These trays 10 provide a place for small parts such as nails, screws, or nuts so they won't roll off of the tray 8. A slot on the side of the tray 8 is for a paint scraper 5.

The tray 8 also features impressions in the plastic to accommodate various sizes and shapes of paint and stain cans. The square gallon holder 4 holds the large square plastic gallon paint containers. The round gallon recess 6, quart recess 9, and pint recess 7 hold round paint and stain cans of their respective size.

Assembly

The tray 8 in FIG. 2 attaches to the straight bar 11 which is welded to a formed rod 16. The tray 8 is riveted on both sides to the rod 16 and bar assembly 19. The rivets 18 are set to allow for free motion between the plastic tray 8 and the metal bar-rod assembly 19.

Mounting on a Ladder

The tray assembly 15 can be used on a number of different ladders with slight modifications to the bar and rod assembly 19. The assembly 15 is mounted on a ladder 12, using two rungs 13 and 14. The top extended portion of the tray 8 is positioned to rest on top of the upper step 13 forming the top resting point. The formed rod 16 is then placed on top of the lower step 14 as shown. Once placed, the tray assembly 15 seats into a rested position ready for use.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A work platform for a multipurpose ladder having a first section and a second section and a hinge attached to the first section and the second section comprising:

a support assembly that removably attaches to the multipurpose ladder which does not have a top, the support assembly having a formed rod placed on top of a first horizontal of the ladder, at least a portion of the formed rod comprising a pair of spaced interconnected curved portion; and a rectangular plastic tray having front and rear peripheral edges joined by opposing peripheral side edges, the tray having a plane extending between front, rear and opposing side peripheral edges, the plane having at least a first bin along the rear edge for holding small parts, a pair of tool lasso slots extending into the plane from the front peripheral edge and spaced inwardly from the opposing side peripheral edges, each tool lasso slot comprising an opening in the front peripheral edge and a circular region that extends into the plane from the opening, each slot is wider at the top than the bottom, at least one screwdriver hole adjacent to the front edge, the support assembly includes a straight bar pivotally attached to the tray at each side peripheral edge adjacent the front peripheral edge, and each straight bar is attached to a respective curved portion of the formed rod which engages the first horizontal of the ladder below the hinge, the tray rear edge comprising a depending flange which engages a second horizontal of the ladder below the hinge and above the first horizontal, the plane has a second bin along the rear edge and disposed adjacent the first bin, the plane has a hammer hole, the plane has a square gallon holder, a circular gallon recess, a circular quart recess and a circular pint recess to hold a gallon, quart and pint container, respectively, the pint recess is disposed in the quart recess and the quart recess is disposed in the gallon recess and the gallon recess is disposed in the gallon holder, and a drill holster slot disposed in the pint recess, the plane has a paint scraper slot at a mid-portion of the plane adjacent to one of the side edge to hold a paint scraper.

2. A platform as described in claim 1 wherein the plane has a screwdriver image adjacent the screwdriver hole.

3. A platform as described in claim 2 wherein the plane has a hammer image adjacent the hammer hole.

4. A platform as described in claim 3 wherein the plane has a paint scraper image adjacent the paint scraper slot.

* * * * *